US008710383B2

(12) United States Patent
Chen

(10) Patent No.: US 8,710,383 B2
(45) Date of Patent: Apr. 29, 2014

(54) THIN FILM SWITCH AND PRESS KEY/KEYBOARD USING THE SAME

(75) Inventor: Chih-Hung Chen, Kaohsiung (TW)

(73) Assignee: Darfon Electronics Corp., Gueishan Township, Taoyuan County (TW)

( * ) Notice: Subject to any disclaimer, the term of this patent is extended or adjusted under 35 U.S.C. 154(b) by 91 days.

(21) Appl. No.: 13/457,578

(22) Filed: Apr. 27, 2012

(65) Prior Publication Data

US 2013/0140164 A1 Jun. 6, 2013

(30) Foreign Application Priority Data

Dec. 6, 2011 (TW) ..... 100222990 U

(51) Int. Cl.
*H01H 9/26* (2006.01)

(52) U.S. Cl.
USPC ..... 200/5 A

(58) Field of Classification Search
USPC ..... 200/5 A, 517, 530, 344, 310–314, 341, 200/345, 340, 510–515
See application file for complete search history.

(56) References Cited

U.S. PATENT DOCUMENTS

| | | | | |
|---|---|---|---|---|
| 4,701,579 | A * | 10/1987 | Kurachi et al. | 200/5 A |
| 6,747,402 | B2 * | 6/2004 | Hato et al. | 313/305 |
| 6,987,466 | B1 * | 1/2006 | Welch et al. | 341/22 |
| 7,525,056 | B2 * | 4/2009 | Chiba et al. | 200/314 |
| 7,999,203 | B2 * | 8/2011 | Cheng | 200/310 |
| 8,222,545 | B2 * | 7/2012 | Tsai | 200/5 A |

* cited by examiner

*Primary Examiner* — Edwin A. Leon
(74) *Attorney, Agent, or Firm* — Winston Hsu; Scott Margo

(57) ABSTRACT

A thin film switch is disclosed, which comprises: a first thin film, having a first conductor unit mounted on a surface thereof; and a second thin film, having a second conductor unit mounted on a surface thereof facing toward the first thin film; wherein, the first conductor unit is composed of a plurality of first electric conductors, and the second conductor is composed of at least one second electric conductor; and the first conductor unit and the second conductor unit are arranged at positions corresponding to each other while being spaced from each other by a specific interval; the at least one second electric conductor is enabled to engage with one of the plural first electric conductors for constructing an electrical conduction when the thin film switch is subjected to a load for forcing the first and the second thin films to move toward each other.

21 Claims, 6 Drawing Sheets

THIN FILM SWITCH AND PRESS KEY/KEYBOARD USING THE SAME

FIELD OF THE INVENTION

The present invention relates to a thin film switch adapted for a press-key or a keyboard, and more particularly, to a thin film switch capable of outputting different signals in response to different forces exerted thereon for triggering different electric conductors mounted on different positions in the thin film switch.

BACKGROUND OF THE INVENTION

With rapid advance in thin film technology, thin film switch is becoming smaller, lighter and thinner that it is vastly used in all kinds of electronic devices. Moreover, since it will not generate loud noise while being pressed, it is especially suitable to be used in press keys or keyboards.

Generally, a conventional thin film switch is primarily composed of two thin films, in that there are two electric conductors disposed respectively on the opposite surfaces of the two thin films at positions corresponding to each other so as to work cooperatively as an electrical switch. That is, by connecting each of the two electric conductors to a circuit formed on its corresponding thin film, an abrupt electrical signal can be produced as soon as the thin film switch is subjected to a normal load for enabling the two electric conductors to engage with each other. Taking a conventional press key using thin film switch for example, it is configured with only one pair of such electric conductors at a position directly corresponding to its keycap. Thereby, when the keycap is subjected to a normal load, the pair of the electric conductors will be forced to engage with each other for producing an electrical signal, i.e. the switch composed of the two electric conductors is triggered. Similarly, for those keyboard composed of a plurality of press key using such thin film switches, the thin film switch of two corresponding electric conductor in each press key can be triggered to produce only one electrical signal as soon as the referring press key is subjected to a normal load. Therefore, when such keyboard is used as a human machine interface for controlling movements of a figure in a computer game operating on a personal computer, the figure can only be directed to perform different movements by pressing different keys on the keyboard. That is, for directing the figure to move continuously upward, downward, to the left and finally to the right, the user must presses on four different keys on the keyboard just for doing so, which can be a tedious and troublesome operation.

SUMMARY OF THE INVENTION

In view of the disadvantages of prior art, the primary object of the present invention is to provide a thin film switch capable of outputting different signals in response to different forces exerted thereon for triggering different electric conductors mounted on different positions in the thin film switch.

To achieve the above object, the present invention provides a thin film switch, comprising:

- a first thin film, having a first conductor unit mounted on a surface thereof; and
- a second thin film, disposed corresponding to the surface of the first thin film where the first conductor unit is mounted while allowing the second thin film to be spaced from the first thin film by a first interval, and having a second conductor unit mounted on a surface of the second thin film that is facing toward the first thin film;

wherein, the first conductor unit is spaced from the second conductor unit by a second interval while enabling the first conductor unit and the second conductor unit to be arranged at positions corresponding to each other; the first conductor unit is composed of a plurality of first electric conductors, and the second conductor is composed of at least one second electric conductor; and thereby, the at least one second conductor is enabled to engage with one of the plural first electric conductors for constructing an electrical conduction when the thin film switch is subjected to a load for forcing the first and the second thin films to move toward each other.

In another embodiment, the present invention further provides a press key using thin film switch, which comprises:

- a thin film switch, disposed at a side of the substrate, and further comprising:
  - a first thin film, having a first conductor unit that is composed of a plurality of first electric conductors and is mounted on a surface of the first thin film; and;
  - a second thin film, disposed corresponding to the surface of the first thin film where the plural first electric conductors is mounted while allowing the second thin film to be spaced from the first thin film by a first interval, and the second thin film further having a second conductor unit, composed of at least one second electric conductor, that is mounted on a surface of the second thin film which is orientated facing toward the first thin film and at a position corresponding to the first conductor unit while allowing the first conductor unit to be spaced from the second conductor unit by a second interval;
- a substrate, disposed on a surface of the thin film switch;
- a keycap, disposed on the substrate;
- an elastic component, disposed at a position between the keycap and the substrate, further having a first protrusion to be formed at a position corresponding to one of the plural first electric conductors; and
- a supporting element, disposed at a position between the keycap and the substrate while movably connecting to the keycap and the substrate for enabling the keycap to move up and down relative to the substrate, and the supporting element further being configured with a second protrusion and a third protrusion at positions respectively corresponding to another two first electric conductors of the plural first electric conductors that are different from the one corresponding to the first protrusion;

wherein, at least one protrusion selected from the first, the second and the third protrusions is driven to move and engage with the thin film switch when the keycap is subjected to a load, and correspondingly, enabling at least one of the first electric conductors to engage with the at least one second electric conductor so as to construct an electrical conduction.

In another embodiment, the present invention further provides a keyboard using thin film switch, which comprises:

- a thin film switch, disposed at a side of the substrate, and further comprising:
  - a first thin film, having a first conductor unit that is composed of a plurality of first electric conductors and is mounted on a surface of the first thin film; and;
  - a second thin film, disposed corresponding to the surface of the first thin film where the plural first electric conductors is mounted while allowing the second thin film to be spaced from the first thin film by a first interval, and the second thin film further having a plurality of second conductor units, each composed of at least one second electric conductor, that are mounted on a surface of the second thin film which is orientated facing toward the first thin film and at positions corresponding to the plural first conductor units corresponding respectively thereto, while allowing the first conductor unit to be spaced from the second conductor unit by a second interval;

a substrate, disposed on a surface of the thin film switch;

a plurality of keycaps, disposed on the substrate;

a plurality of elastic components, each disposed at a position between the keycap corresponding thereto and the substrate, and each further having a first protrusion to be formed at a position corresponding to one of the plural first electric conductors; and a plurality of supporting elements, each disposed at a position between the keycap corresponding thereto and the substrate while movably connecting to the keycap corresponding thereto and the substrate for enabling the corresponding keycap to move up and down relative to the substrate; and each supporting element further being configured with a second protrusion and a third protrusion at positions respectively corresponding to another two first electric conductors of the plural first electric conductors that are different from the one corresponding to the first protrusion wherein, at least one protrusion selected from the first, the second and the third protrusions is driven to move and engage with the thin film switch when the keycap is subjected to a load, and correspondingly, enabling at least one of the first electric conductors to engage with the at least one second electric conductor so as to construct an electrical conduction.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
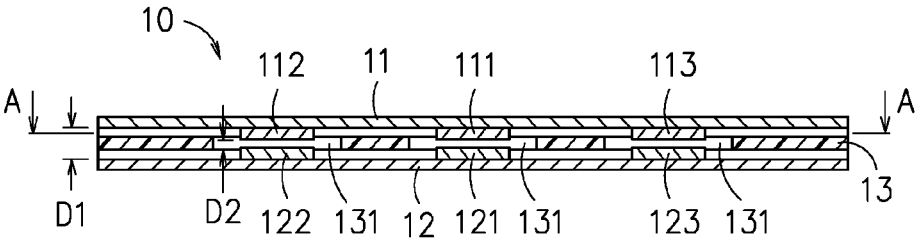
FIG. 1 is a sectional view of a thin film switch according to a first embodiment of the present invention.
Figure 2:
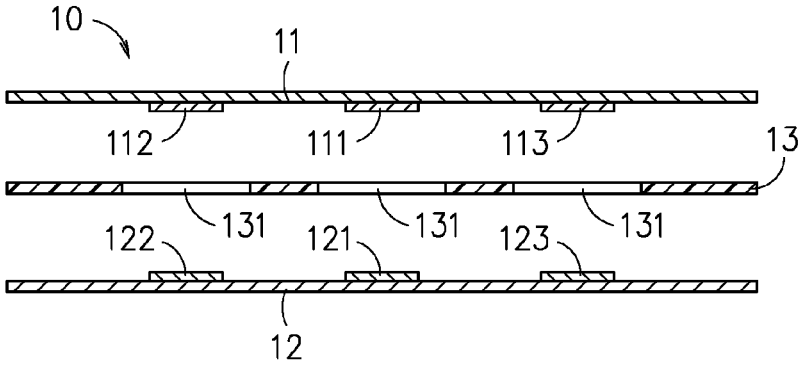
FIG. 2 is an exploded view of the thin film switch shown in the first embodiment of the present invention.
Figure 3:
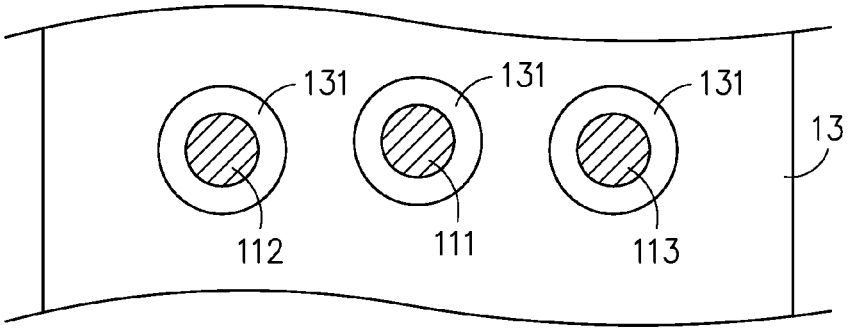
FIG. 3 is a schematic diagram showing an A-A cross section of FIG. 1.

Please refer to FIG. 1 to FIG. 3, which are schematic diagrams showing a thin film switch according to a first embodiment of the present invention. In FIG. 1 to FIG. 3, a thin film switch 10 in this embodiment is composed of a first thin film 11 and a second thin film 12, in which both the first thin film 11 and the second thin film 12 have circuits formed thereon in respective. Moreover, the first thin film 11 is configured with a first conductor unit on a surface thereof, and in this first embodiment, such first conductor unit is composed of three first electric conductors 111, 112, and 113 in a manner that the three first electric conductors 111, 112, and 113 are arranged in a line. The second thin film 12 is disposed corresponding to the surface of the first thin film 11 where the first conductor unit is mounted, and has a second conductor unit mounted on a surface of the second thin film 12 that is facing toward the first thin film 11. In this embodiment, the second conductor unit is composed of three second electric conductors 121, 122 and 123. Since the second conductor unit should be grounded, either the three second electric conductors 121, 122 and 123 are arranged first being serially connected to one another while being grounded, or the three second electric conductors 121, 122 and 123 can be grounded respectively and independently through a ground cable. As shown in FIG. 1 to FIG. 3, the three second electric conductors 121, 122 and 123 are arranged at positions corresponding to the three first electric conductors 111, 112, and 113 in an one-by-one manner. Furthermore, in this embodiment, there is a spacer layer 13 being sandwiched between the first thin film 11 and the second thin film 12, which is formed with a plurality of holes 131 of different diameters on the spacer layer 13 at positions corresponding to the three first electric conductors 111, 112, 113 in respective. In addition, the first thin film 11 is spaced from the second thin film 12 by an interval D1, and the second conductor unit, i.e. the second electric conductors 121, 122, 123, is spaced from the first conductor unit, i.e. the first electric conductors 111, 112, 113, by another interval D2. Thereby, those second electric conductors 121, 122, 123 are not engaged with the first electric conductors 111, 112, 113 when the thin film switch 10 is not subjected to a normal load, as shown in FIG. 1. However, if the thin film switch 10 is subjected to a normal load for forcing the first thin film 11 and the second thin film 12 to move toward each other, the first electric conductors 111, 112, 113 will be driven to move crossing through the holes 131 corresponding thereto and thus engage with the second electric conductors 121, 122, 123 for construction the electrical conduction between the circuits formed on the first thin film 11 and the second thin film 12.

Figure 4:
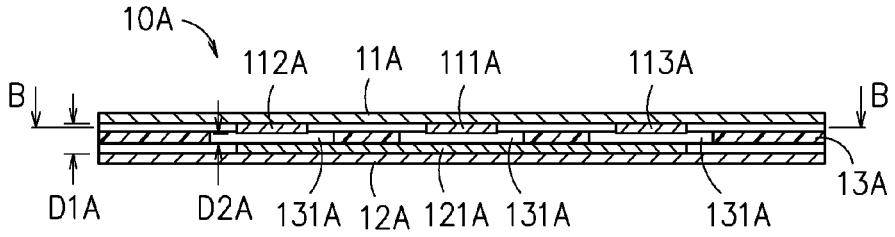
FIG. 4 is a sectional view of a thin film switch according to a second embodiment of the present invention.
Figure 5:
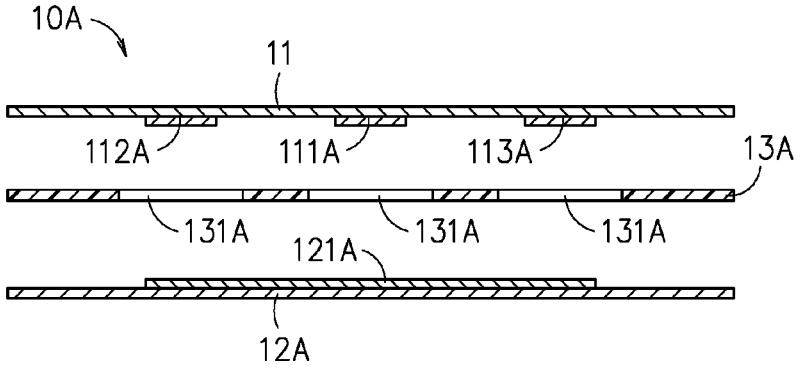
FIG. 5 is an exploded view of the thin film switch shown in the first embodiment of the present invention.
Figure 6:
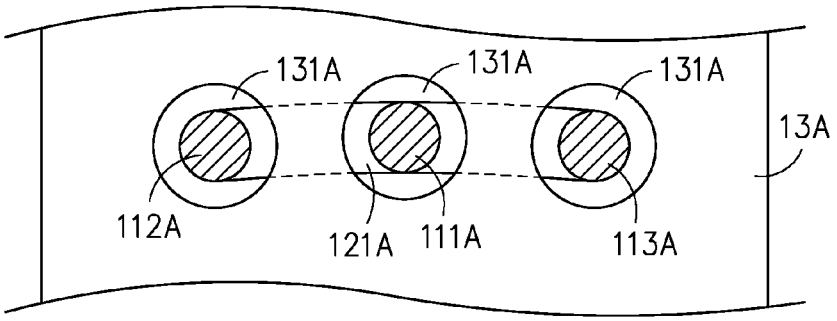
FIG. 6 is a schematic diagram showing a B-B cross section of FIG. 4.

Please refer to FIG. 4 to FIG. 6, which are schematic diagrams showing a thin film switch according to a first embodiment of the present invention. In FIG. 4 to FIG. 6, a thin film switch 10A in this embodiment is composed of a first thin film 11A and a second thin film 12A, in which both the first thin film 11A and the second thin film 12A have circuits formed thereon in respective. Moreover, the first thin film 11A is configured with a first conductor unit on a surface thereof, and in this first embodiment, such first conductor unit is composed of three first electric conductors 111A, 112A, and 113A, while the second thin film 12A has a second conductor unit mounted thereon. The different between this second embodiment and the first embodiment is that: instead of three second electric conductors, there is only one second electric conductor 121A that is included in the second conductor unit while being grounded; and consequently, the three first electric conductors 111A, 112A and 113A are to be disposed distributing within an area on the first film 11A defined by the projection of the second electric conductor 121A. Similarly, there is a spacer layer 13A being sandwiched between the first thin film 11A and the second thin film 12A, which is formed with a plurality of holes 131A on the spacer layer 13A. In addition, the first thin film 11A is spaced from the second thin film 12A by an interval D1A, and the second conductor unit, i.e. the second electric conductor 121A, is spaced from the first conductor unit, i.e. the first electric conductors 111A, 112A, 113A, by another interval D2A. Thereby, the second electric conductor 121A is not engaged with the first electric conductors 111A, 112A, 113A when the thin film switch 10A is not subjected to a normal load, as shown in FIG. 4. However, if the thin film switch 10A is subjected to a normal load for forcing the first thin film 11A and the second thin film 12A to move toward each other, the first electric conductors 111A, 112A, 113A will be driven to move crossing through the holes 131A corresponding thereto and thus engage with the second electric conductor 121A for construction the electrical conduction.

It is noted from the thin film switches 10 and 10A shown in the two forgoing embodiments that there can be equal amounts of the first electric conductors and the second electric conductors being arranged respectively on the first and the second thin films of the same thin film switch, as the three first electric conductors 111, 112, 113 and the three second electric conductors, 121, 122, 123 illustrated in the first embodiment of the invention, but on the other hand, there can be only one second electric conductor being arranged at a position corresponding to a plurality of said first conductor, such as the one second electric conductor 121A and the three first electric conductors 111A, 112A, 113A shown in the second embodiment of the invention. Moreover, it is not necessary for the first thin film 11 to be disposed on top of the second thin film 12 as shown in the thin film switch 10 shown in the first embodiment so that the second thin film 12 along with the second electric conductors 122, 123, 124 and the circuits can be used as an upper layer while the first thin film 11 along with the first electric conductors 111, 112, 113 and the circuits can be used as the bottom layer in the thin film switch 10, which is also true for the first thin film 11A and the second thin film 12A in the thin film switch 10A shown in the second embodiment.

Figure 7:
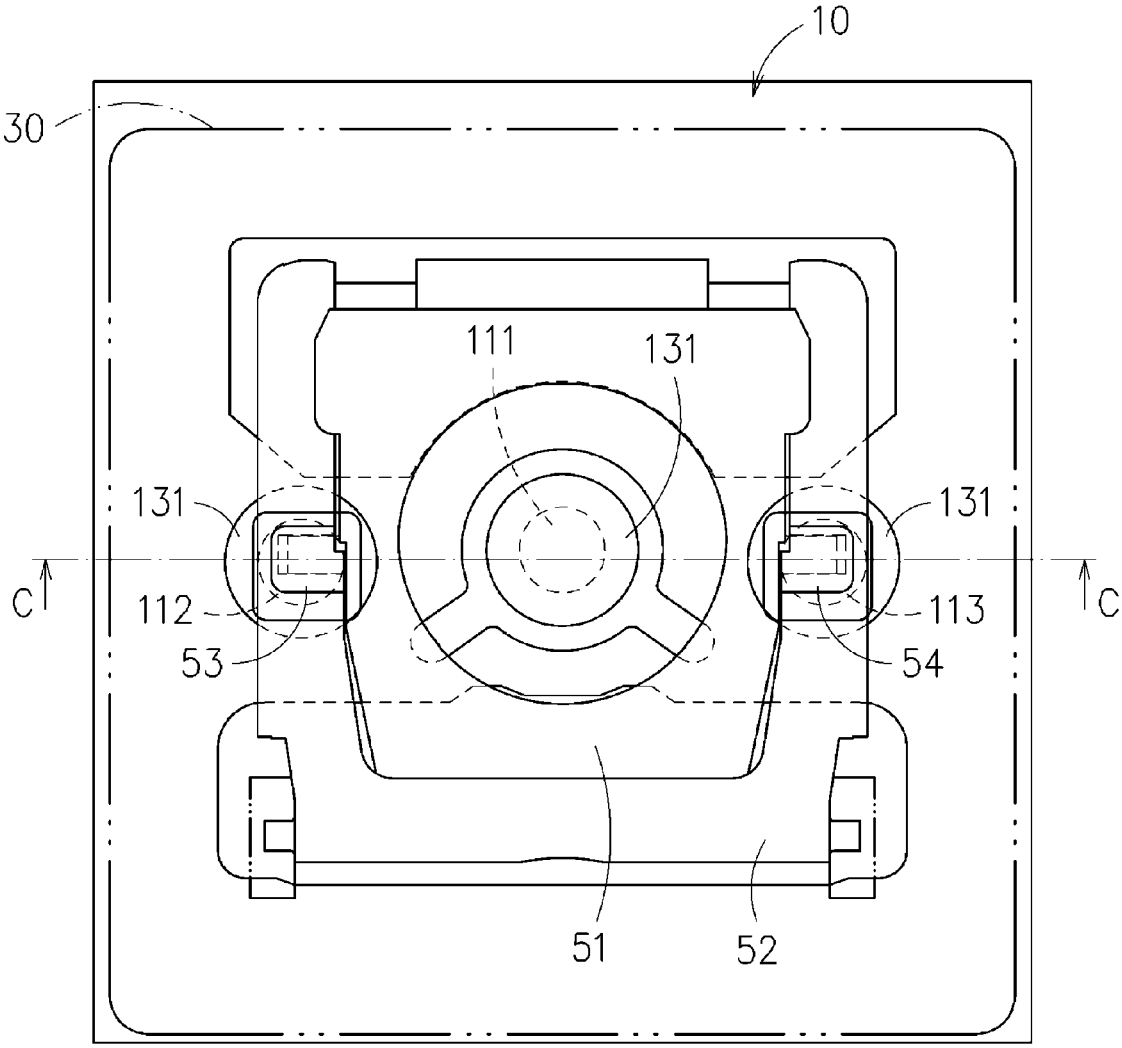
FIG. 7 is a top view of a press key using a thin film switch according to the present invention.
Figure 8:
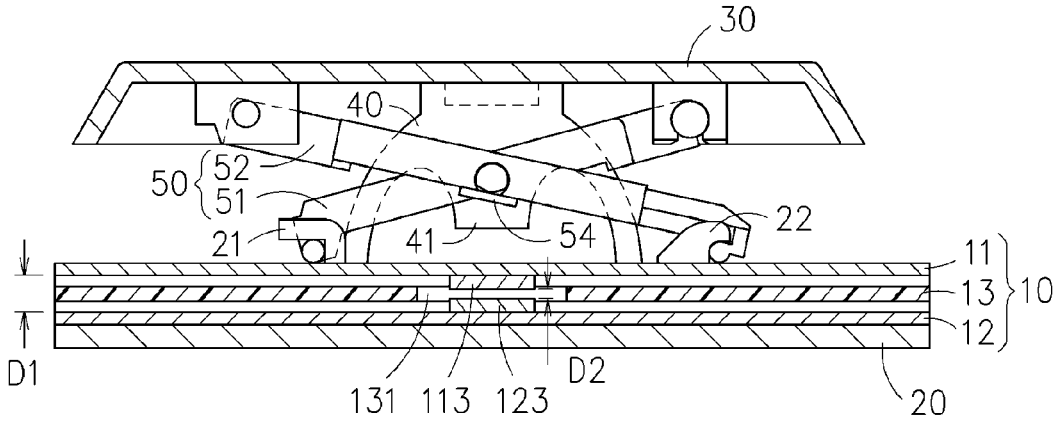
FIG. 8 is a side view of FIG. 7.
Figure 9:
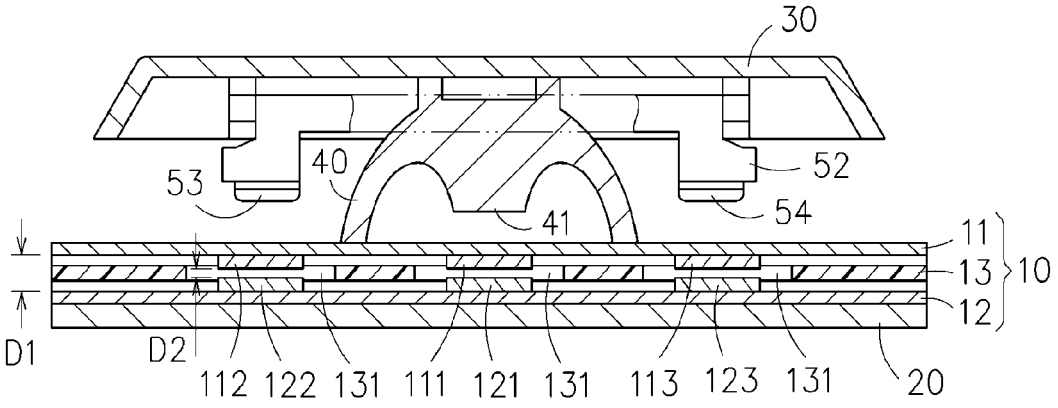
FIG. 9 is a schematic diagram showing a C-C cross section of FIG. 7.

Please refer to FIG. 7 to FIG. 9, which show a press key using thin film switch of the present invention. The press key shown in FIG. 7 is composed of a thin film switch 10, a substrate 20, a keycap 30, and elastic component 40 and a supporting element 50, in which the thin film switch 10 is constructed structural the same as the thin film switch 10 shown in FIG. 1 and FIG. 2 and is composed of a first thin film 11 and a second thin film 12. Similarly, there is a first conductor unit mounted on the first thin film 11 that is composed of three first electric conductors 111, 112, and 113, while there is also a second conductor unit mounted on the second thin film 12 that is composed of three second electric conductors 121, 122, and 123 at positions respectively corresponding to the three first electric conductors 111, 112, and 113 while being grounded. Moreover, there is a spacer layer 13 being sandwiched between the first thin film 11 and the second thin film 12, which is formed with a plurality of holes 131 on the spacer layer 13 at positions corresponding respectively to the three first electric conductors 111, 112, and 113. In addition, the first thin film 11 is spaced from the second thin film 12 by an interval D1, and the second conductor unit, i.e. the second electric conductors 121, 122, 123, is spaced from the first conductor unit, i.e. the first electric conductors 111, 112, 113, by another interval D2.

Generally, the substrate 20 is made of a metal, which is configured with two upward-extending hooks 21, 22 that are arranged piecing the thin film switch 10 so as to be used for fastening and thus fixedly securing the supporting element 50. In this embodiment, the keycap 30 is disposed above the substrate 20 while the substrate 20 is attached to the bottom surface of the thin film switch 10 and the keycap 30 is disposed above the top surface of the thin film switch 10. Moreover, the elastic component 40, that is generally made of a rubber, is being disposed at a position between the keycap 30 and the substrate 20 and is formed with a first protrusion 41 at a side thereof facing toward the thin film switch 10 while allowing the protrusion 41 to be positioned corresponding to the first electric conductor 112. In this embodiment, the first protrusion 41 is arranged at a position corresponding to the first electric conductor 111 that is located in the middle of the assembly of the three first electric conductors 111, 112, 113.

In this embodiment, the supporting element 50 can substantially be a scissors-type supporting part, configured by the use of a first and a second pivot axes 51, 52 that are coupled to each other while enabling one end of the first pivot axis 51 to be moveably couple to the keycap 30 and another end of the first pivot axis opposite thereto to moveably coupled to one of the two hooks 21 formed on the substrate 20, and simultaneously enabling one end of the second pivot axis 52 to be moveably coupled to the keycap 30 and another end of the second pivot axis 52 opposite thereto to be moveably coupled to another hook 22 on the substrate 20; and thereby, the elastic component 40 is received inside the scissors-type supporting part 50, and as the supporting element 50 in this embodiment is further configured with a second protrusion 53 and a third protrusion 51 at positions respectively corresponding to another two first electric conductors 112, 113 that are different from the one 111 corresponding to the first protrusion 41, the second and the third protrusions 53, 54 are arranged respectively at two opposite sides proximate to the joint of the first and the second pivot axes 51, 52 for enabling the second and the third protrusions 53, 54 to be disposed respectively at two opposite positions relative to the first protrusion 41. It is noted that the supporting element 50 is arranged at a position between the keycap 30 and the substrate 20 while movably connecting to the keycap 30 and the substrate 20 for enabling the keycap 30 to move up and down relative to the substrate 20, i.e. relative to the thin film switch 10.

In this embodiment, the first, the second and the third protrusions 41, 53, and 54 are arranged at positions corresponding to the first electric conductors 111, 112, and 113 in respective, while allowing the second and the third protrusions 53, 54 to be mounted on the second pivot axis 52 at positions corresponding to the first electric conductors 112, 113 that are arranged at two opposite sides of the first electric conductor 111. However, if the second and the third protrusions 53, 54 are mounted on the first pivot axis 51 instead of being mounted on the second pivot axis 52, the distance between the second and the third protrusions 53, 54, as well as the distances between the second protrusion 53 and the first protrusion 41, and that between the third protrusion 54 and the first protrusion 41, will be shortened, and thus, the first electric conductors 112, and 113 should be moved to another positions that are corresponding to the second and the third protrusions 53, 54 in respective. In another word, the positioning relating to the first, the second and the third protrusions 41, 53, 54, as well as the positioning relating to the three first electric conductors 111, 112, 133, are not limited by the aforesaid embodiments, only if the first, the second and the third protrusions 41, 53, 54 are arranged at positions corresponding to the three first electric conductors 111, 112, 133 in respective.

Figure 10:
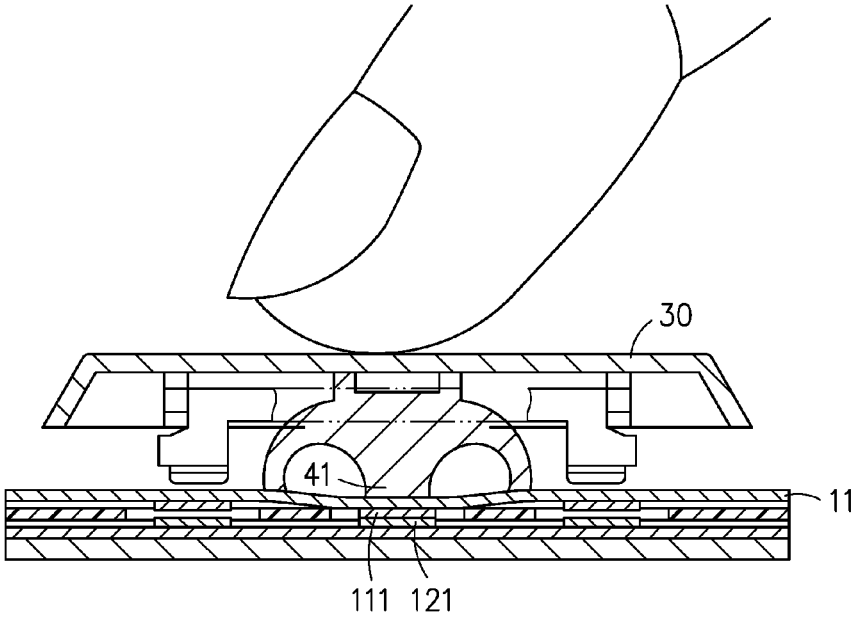
FIG. 10 to FIG. 13 are schematic diagrams showing how a press key is enables to output different signals simply by exerting different forces upon its keycap for triggering a different electric conductors located at different positions in a thin film switch under the keycap.

When the keycap 30 is being pressed at the middle thereof by a user, as shown in FIG. 10, the first protrusion 41 is being forced to move downward and press on the first thin film 11, causing the first thin film 11 and the protrusion 41 to deformed while allowing the first thin film 11 to contact with the second thin film 12, and consequently, the first electric conductor 111 can be driven to engage with the second electric conductor 121 for enabling an electrical conduction so as to trigger a first signal to be emitted through the circuits that are connected respectively to the first electric conductor 111 and the second electric conductor 121.

Figure 11:
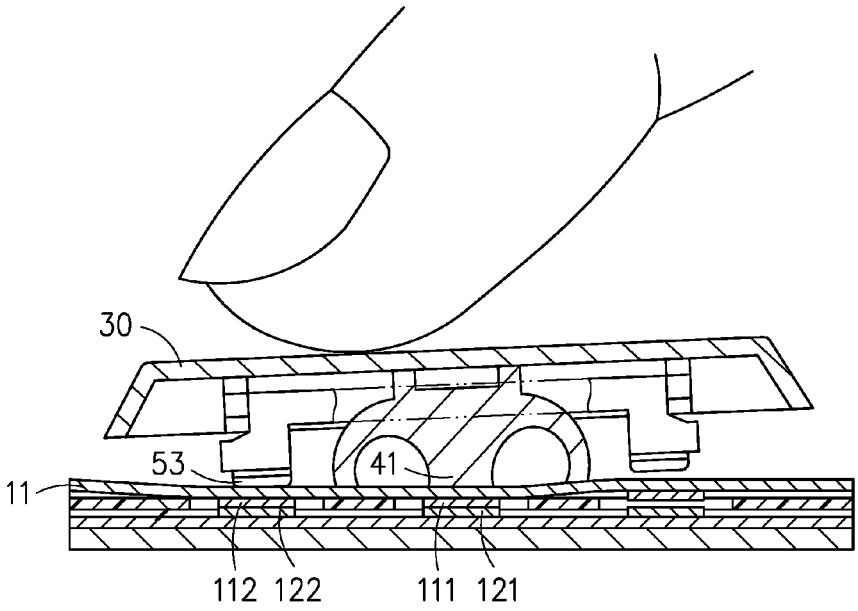

When the keycap 30 is being pressed at the left portion thereof by a user, as shown in FIG. 11, the first protrusion 41 along with the second protrusion 53 are being forced to move downward and press on the first thin film 11, causing the first electric conductor 111 that is disposed at the middle to engage with the second electric conductor 121 while simultaneously causing the first electric conductor 112 arranged left to the middle first electric conductor 111 to engage with its corresponding second electric conductor 122, and thereby an electrical conduction is constructed so as to trigger a second signal to be emitted through the circuits that are connected respectively to the first electric conductors 111, 112 and the second electric conductors 121, 122.

Figure 12:
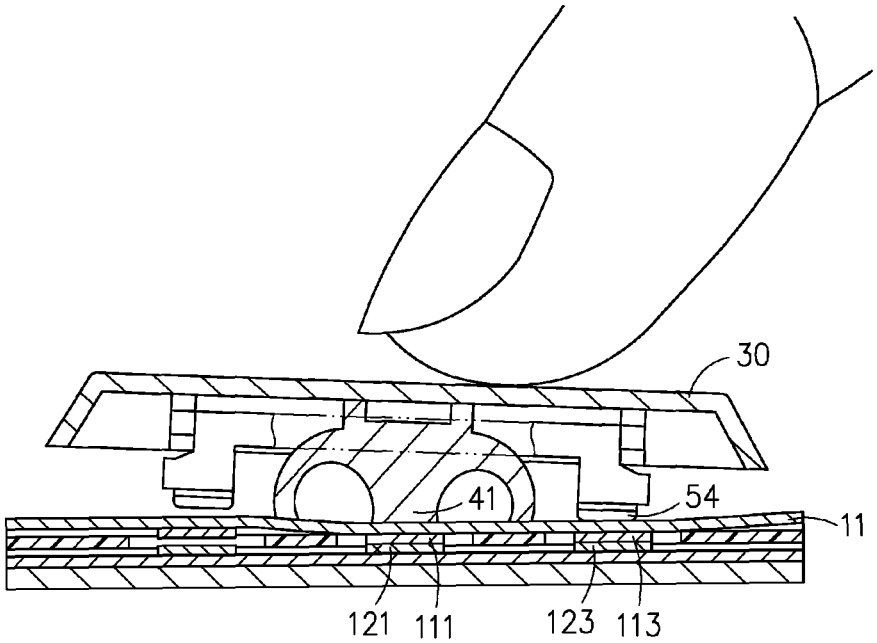

When the keycap 30 is being pressed at the right portion thereof by a user, as shown in FIG. 12, the first protrusion 41 along with the third protrusion 54 are being forced to move downward and press on the first thin film 11, causing the first electric conductor 111 that is disposed at the middle to engage with the second electric conductor 121 while simultaneously causing the first electric conductor 113 arranged right to the middle first electric conductor 111 to engage with its corresponding second electric conductor 123, and thereby an electrical conduction is constructed so as to trigger a third signal to be emitted through the circuits that are connected respectively to the first electric conductors 111, 113 and the second electric conductors 121, 123.

Figure 13:
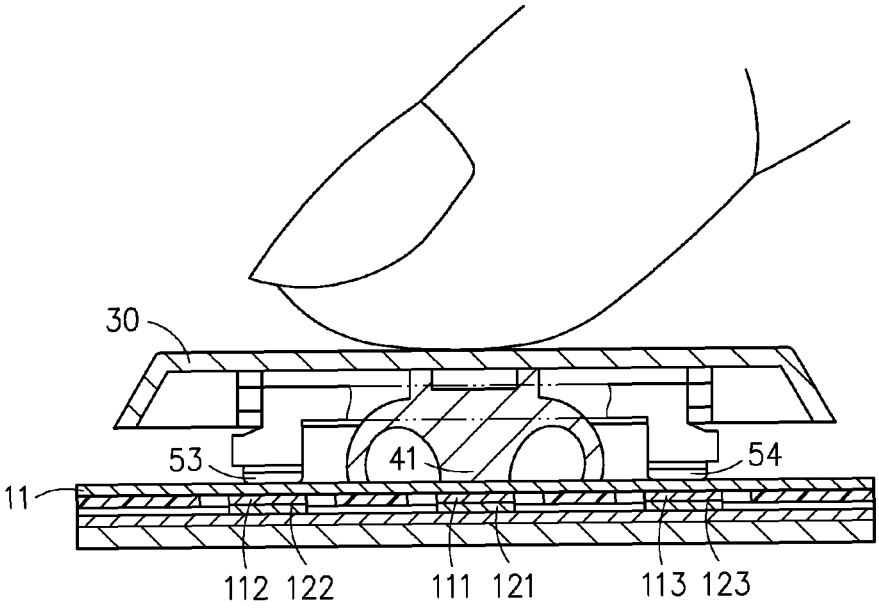

Furthermore, when the keycap 30 is being pressed hard at the middle thereof by a user, as shown in FIG. 12, the first protrusion 41 along with the second and the third protrusions 53, 54 are being forced to move downward and press on the first thin film 11 at the same time, causing the three first electric conductor 111, 112, and 123 to engage simultaneously with the second electric conductors 121, 122, and 123, and thereby an electrical conduction is constructed so as to trigger a fourth signal to be emitted through the circuits that are connected respectively to the first electric conductors 111, 112, 113 and the second electric conductors 121 122, 123. Comparing the two pressing situations shown in FIG. 10 and FIG. 13, it is obvious that the pressing force pressing on the keycap 30 that is shown in FIG. 10 is smaller than that shown in FIG. 13, resulting that only the first electric conductor 111 that is arranged at the middle is enabled to engage with its corresponding second electric conductor 121 when the keycap 30 is being pressed by a comparatively smaller force, but on the other hand, when the keycap 30 is being pressed by a comparatively larger force, as shown in FIG. 13, all the first electric conductors 111, 112, and 123 will be enabled to engage with their corresponding second electric conductors 121, 122, and 123. In addition, since the first protrusion 41 is made of an elastic material, it is possible to formed a longer first protrusion 41 for allowing the distance between the tip of the first protrusion 41 to be smaller that the distance between the tip of the second protrusion 53 and the thin film switch 10, as well as that between the tip of the third protrusion 54 and the thin film switch 10.

In the embodiment shown in FIG. 10 to FIG. 13, three first electric conductors 111, 112, 113 are paired with their corresponding second electric conductors 121, 122, 123 into three conductor sets, by that it is possible to trigger and emit four different signals simply by exerting different forces upon the same press key using thin film switch of the present invention. Thus, if there are two such press keys in a keypad, there can be as many as eight different signals capable of being emitted by the use of the keypad. Consequently, the amount of signals capable of being emitted from a keypad is about four times that amount of press keys that are included in the keypad. Nevertheless, the amount of conductor sets in the thin film switch of the present invention is not limited by the aforesaid embodiments, i.e. there can be more or less than three conductor sets being included in the thin film switch. For instance, there can be two or four conductor sets in the thin film switch, whichever is determined according to the size of the press key and also according to actual requirement.

Moreover, since the holes 131 in the spacer layer 13 of the thin film switch 10 are formed with different diameters, the exerting of forces of different magnitudes upon the thin film switch is going to cause different electrical conduction in different sets of corresponding first and second electric conductors. Thus, it is possible to emit such four different signals according to the magnitude of force that is to be pressed on the middle of the keycap 30 without being off-center to the left or to the right.

To sum up, the present invention provides a thin film switch, that is capable of outputting different signals in response to different forces exerted thereon for triggering different electric conductors mounted on different positions in the thin film switch. That is, with the aforesaid structure, it is possible to trigger and emit different signals simply by exerting different forces upon the same thin film switch of the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A press key using thin film switch, which comprises:

a thin film switch, disposed at a side of the substrate, and further comprising:

a first thin film, having a first conductor unit that is composed of a plurality of first electric conductors and is mounted on a surface of the first thin film; and;

a second thin film, disposed corresponding to the surface of the first thin film where the plurality of first electric conductors is mounted while allowing the second thin film to be spaced from the first thin film by a first interval, and the second thin film further having a second conductor unit, composed of at least one second electric conductor, that is mounted on a surface of the second thin film which is orientated facing toward the first thin film and at a position corresponding to the first conductor unit while allowing the first conductor unit to be spaced from the second conductor unit by a second interval;

a substrate, disposed on a surface of the thin film switch;

a keycap, disposed on the substrate;

an elastic component, disposed at a position between the keycap and the substrate, further having a first protrusion to be formed at a position corresponding to one of the plural first electric conductors; and a supporting element, disposed at a position between the keycap and the substrate while movably connecting to the keycap and the substrate for enabling the keycap to move up and down relative to the substrate, and the supporting element further being configured with a second protrusion and a third protrusion at positions respectively corresponding to another two first electric conductors of the plural first electric conductors that are different from the one corresponding to the first protrusion;

wherein, at least one protrusion selected from the first, the second and the third protrusions is driven to move and engage with the thin film switch when the keycap is subjected to a load, and correspondingly, enabling at least one of the first electric conductors to engage with the at least one second electric conductor so as to construct an electrical conduction.

2. The press key of claim 1, wherein the supporting element is substantially a scissors-type supporting part, configured by the use of a first and a second pivot axes that are coupled to each other while enabling one end of the first pivot axis to be moveably coupled to the keycap and another end of the first pivot axis opposite thereto to be moveably coupled to the substrate, and simultaneously enabling one end of the second pivot axis to be moveably coupled to the keycap and another end of the second pivot axis opposite thereto to be moveably coupled to the substrate; and thereby, the elastic component is received inside the scissors-type supporting part, and the second and the third protrusions are arranged respectively at two opposite sides proximate to the joint of the first and the second pivot axes for enabling the second and the third protrusions to be disposed respectively at two opposite positions relative to the first protrusion.

3. The press key of claim 1, wherein the second conductor is composed of one said second electric conductor, while enabling the plural first electric conductors to be disposed distributing within an area on the first film defined by the projection of the second electric conductor.

4. The press key of claim 1, wherein the second conductor is composed of a plurality of said second electric conductors in an amount equal to that of the first electric conductors, while enabling the plural second electric conductors to be arranged at positions corresponding to the plural first electric conductors in an one-by-one manner.

5. The press key of claim 1, wherein the second conductor unit is grounded.

6. The press key of claim 1, wherein the plural first electric conductors are arranged in a line.

7. The press key of claim 1, wherein the first and the second thin films are respectively being formed with circuits, that can be electrically conducted as soon as the plural first electric conductors are enabled to engaged with the at least one second electric conductors.

8. The press key of claim 1, further comprising:

a spacer layer, arranged between the first thin film and the second thin film, having a plurality of holes formed thereon in different diameters and at positions corresponding to the plural first electric conductors for enabling the plural first electric conductors to cross through the holes corresponding thereto and thus engage with the plural second electric conductors for construction the electrical conduction when the first thin film and second thin film are forced to move toward each other.

9. A keyboard using thin film switch, comprising:

a thin film switch, disposed at a side of the substrate, and further comprising:

a first thin film, having a first conductor unit that is composed of a plurality of first electric conductors and is mounted on a surface of the first thin film; and;

a second thin film, disposed corresponding to the surface of the first thin film where the plural first electric conductors is mounted while allowing the second thin film to be spaced from the first thin film by a first interval, and the second thin film further having a plurality of second conductor units, each composed of at least one second electric conductor, that are mounted on a surface of the second thin film which is orientated facing toward the first thin film and at positions corresponding to the plural first conductor units corresponding respectively thereto, while allowing the first conductor unit to be spaced from the second conductor unit by a second interval;

a substrate, disposed on a surface of the thin film switch;

a plurality of keycaps, disposed on the substrate;

a plurality of elastic components, each disposed at a position between the keycap corresponding thereto and the substrate, and each further having a first protrusion to be formed at a position corresponding to one of the plural first electric conductors; and a plurality of supporting elements, each disposed at a position between the keycap corresponding thereto and the substrate while movably connecting to the keycap corresponding thereto and the substrate for enabling the corresponding keycap to move up and down relative to the substrate; and each supporting element further being configured with a second protrusion and a third protrusion at positions respectively corresponding to another two first electric conductors of the plural first electric conductors that are different from the one corresponding to the first protrusion wherein, at least one protrusion selected from the first, the second and the third protrusions is driven to move and engage with the thin film switch when the keycap is subjected to a load, and correspondingly, enabling at least one of the first electric conductors to engage with the at least one second electric conductor so as to construct an electrical conduction.

10. The keyboard of claim 9, wherein each supporting element is substantially a scissors-type supporting part, configured by the use of a first and a second pivot axes that are coupled to each other while enabling one end of the first pivot axis to be moveably coupled to the keycap corresponding thereto and another end of the first pivot axis opposite thereto to be moveably coupled to the substrate, and simultaneously enabling one end of the second pivot axis to be moveably coupled to the keycap corresponding thereto and another end of the second pivot axis opposite thereto to be moveably coupled to the substrate; and thereby, the elastic component corresponding thereto is received inside the scissors-type supporting part, and the second and the third protrusions are arranged respectively at two opposite sides proximate to the joint of the first and the second pivot axes for enabling the second and the third protrusions to be disposed respectively at two opposite positions relative to the first protrusion.

11. The keyboard of claim 9, wherein the second conductor is composed of one said second electric conductor, while enabling the plural first electric conductors to be disposed distributing within an area on the first film defined by the projection of the second electric conductor.

12. The keyboard of claim 9, wherein the second conductor is composed of a plurality of said second electric conductors in an amount equal to that of the first electric conductors, while enabling the plural second electric conductors to be arranged at positions corresponding to the plural first electric conductors in an one-by-one manner.

13. The keyboard of claim 9, wherein each of the at least one second electric conductor is grounded.

14. The keyboard of claim 9, wherein the plural first electric conductors are arranged in a line.

15. The keyboard of claim 9, wherein the first and the second thin films are respectively being formed with circuits, that can be electrically conducted as soon as the plural first electric conductors are enabled to engaged with the at least one second electric conductors.

16. The keyboard of claim 9, further comprising:

a spacer layer, arranged between the first thin film and the second thin film, having a plurality of holes formed thereon in different diameters and at positions corresponding to the plural first electric conductors for enabling the plural first electric conductors to cross through the holes corresponding thereto and thus engage with the plural second electric conductors for construction the electrical conduction when the first thin film and second thin film are forced to move toward each other.

17. A press key comprises:

a thin film switch comprising:

a upper film having a first upper electric conductor and a second upper electric conductor;

a lower film spaced from the upper film, and the lower film having a first lower electric conductor and a second lower electric conductors formed on a film surface facing toward the upper film and at a position respectively corresponding to the first upper and second upper electric conductors, while allowing the first upper and second upper electric conductors to be spaced from the first lower and second lower electric conductors;

a substrate, disposed below the thin film switch;

a keycap, disposed above the thin film switch;

an elastic component, disposed between the keycap and the substrate, and a supporting element, movably connecting to the keycap and the substrate for enabling the keycap to move upward and downward, and the supporting element having a first protrusion and a second protrusion formed at positions respectively corresponding to the first and the second upper electric conductors respectively;

wherein when the keycap is pressed, at least one of the first protrusion and the second protrusion moves downward to engage with the thin film switch, and makes at least either that the first upper electric conductor contacts with the first lower electric conductor, or that the second upper electric conductor contacts with the second lower electric conductors.

18. The press key of claim 17, wherein the supporting element is a scissors-like structure comprising a first lever and a second lever coupled to each other at a first pivot joint and a second pivot joint, the first lever comprises a first higher end and a first lower end, the second lever comprises a second higher end and a second lower end, the first higher end and the second higher end are moveably coupled to the keycap, the first protrusion and the second protrusion are respectively disposed at two opposite sides relative to the center of the keycap.

19. The press key of claim 18, wherein the first lever dimension is larger than the second lever dimension, and the first protrusion and the second protrusion are both formed on the first lever.

20. The press key of claim 18, wherein the first protrusion is formed at a first bottom surface neighboring to the first pivot joint, and the second protrusion is formed at a second bottom surface neighboring to the second pivot joint.

21. The press key of claim 20, wherein the first bottom surface is right below the first pivot joint, and the second bottom surface is right below the second pivot joint.

* * * * *